US007591572B1

(12) United States Patent
Levine

(10) Patent No.: US 7,591,572 B1
(45) Date of Patent: Sep. 22, 2009

(54) COMPACT LIGHTING DEVICE

(76) Inventor: Jonathan E. Levine, 419 Park Ave. South, Suite 505, New York, NY (US) 10016

( * ) Notice: Subject to any disclaimer, the term of this patent is extended or adjusted under 35 U.S.C. 154(b) by 286 days.

(21) Appl. No.: 11/734,022

(22) Filed: Apr. 11, 2007

(51) Int. Cl.
*F21S 8/002* (2006.01)

(52) U.S. Cl. ..... 362/427; 362/191; 362/365; 362/370; 362/421; 362/419

(58) Field of Classification Search ..... 362/427, 362/191, 365, 368, 370, 371, 419, 421
See application file for complete search history.

(56) References Cited

U.S. PATENT DOCUMENTS

| | | | | |
|---|---|---|---|---|
| 2,345,235 | A | | 3/1944 | Carter, Jr. |
| 2,595,520 | A | | 5/1952 | Guerin |
| 2,790,894 | A | | 4/1957 | Zingone |
| 3,786,245 | A | * | 1/1974 | Cincotta et al. ..... 362/183 |
| D264,254 | S | | 5/1982 | Heritage |
| 4,494,177 | A | | 1/1985 | Matthews |
| D278,461 | S | | 4/1985 | Pepall |
| 4,515,570 | A | | 5/1985 | Beltran |
| 4,528,618 | A | | 7/1985 | Bitsch |
| 4,533,982 | A | * | 8/1985 | Kozar ..... 362/183 |
| 4,595,970 | A | | 6/1986 | Diffrient |
| D290,294 | S | | 6/1987 | Sano et al. |
| D290,884 | S | | 7/1987 | Sano et al. |
| D292,236 | S | | 10/1987 | Caldwell |
| D293,940 | S | | 1/1988 | Lasker |
| 4,751,627 | A | | 6/1988 | Usher |
| D299,549 | S | | 1/1989 | Macaluso |
| 4,816,969 | A | | 3/1989 | Miller |
| D312,136 | S | | 11/1990 | Miletich et al. |
| 4,977,489 | A | | 12/1990 | Fung |
| 5,012,394 | A | | 4/1991 | Woodward |
| D320,863 | S | | 10/1991 | Macaluso |
| D327,334 | S | | 6/1992 | Parker |
| 5,169,226 | A | | 12/1992 | Friedman |
| 5,265,000 | A | | 11/1993 | Lin |
| D350,620 | S | | 9/1994 | Yuen |
| D357,993 | S | | 5/1995 | Yuen |

(Continued)

OTHER PUBLICATIONS

"Notice of Allowance and Fee(s) Due" for U.S. Appl. No. 29/281,046, 13 pages.

(Continued)

*Primary Examiner*—Ricky L Mack
*Assistant Examiner*—Mark Tsidulko
(74) *Attorney, Agent, or Firm*—Theodore W. Baker

(57) ABSTRACT

A lighting device is disclosed. The lighting device can include a base, a light source housing, and a connection member connected between the base and the light source housing. The lighting device also can include a rotatable mounting plate. The light source housing can be elongated and can include one or more battery-powered lighting elements, such as light-emitting diodes. The lighting device can be convertible between a compact configuration and an expanded configuration. The light source housing and the connection member together can be rotatable relative to the base around a first axis. The light source housing also can be rotatable relative to the connection member around a second axis substantially parallel to the first axis and a third axis substantially perpendicular to the first axis. Batteries to power the lighting elements can be positioned within a battery compartment of a removable battery pack within the base.

17 Claims, 5 Drawing Sheets

U.S. PATENT DOCUMENTS

| | | | | |
|---|---|---|---|---|
| D366,337 | S | 1/1996 | Yuen | |
| 5,595,436 | A | 1/1997 | Way, Jr. et al. | |
| 5,765,939 | A | 6/1998 | Tanner, Jr. | |
| 5,769,529 | A | 6/1998 | Weinstock et al. | |
| D397,478 | S | 8/1998 | Booty, Jr. | |
| 5,795,050 | A | 8/1998 | Carter | |
| 5,871,274 | A | 2/1999 | Lee et al. | |
| D408,567 | S | 4/1999 | Coe | |
| 5,934,787 | A | 8/1999 | Sharma | |
| 6,022,119 | A | 2/2000 | Booty, Jr. | |
| D423,130 | S | 4/2000 | Kung | |
| D424,223 | S | 5/2000 | Fun | |
| 6,146,001 | A | 11/2000 | Cwiakala | |
| D435,677 | S | 12/2000 | Hollinger | |
| 6,206,541 | B1 | 3/2001 | Landamia | |
| 6,390,652 | B1 | 5/2002 | Echito | |
| 6,406,161 | B1 * | 6/2002 | Lin et al. | 362/427 |
| 6,536,924 | B2 | 3/2003 | Segretto | |
| 6,566,824 | B2 | 5/2003 | Panagotacos et al. | |
| 6,588,920 | B2 | 7/2003 | Agro | |
| 6,619,813 | B1 | 9/2003 | Schnell | |
| 6,641,283 | B1 | 11/2003 | Bohler | |
| 6,726,502 | B1 | 4/2004 | Hayes | |
| D490,925 | S | 6/2004 | Wilmotte | |
| 6,827,465 | B2 | 12/2004 | Shemitz et al. | |
| 6,877,875 | B2 | 4/2005 | Yu et al. | |
| D506,560 | S | 6/2005 | Oas | |
| D507,373 | S | 7/2005 | Kim | |
| 6,955,442 | B1 | 10/2005 | Chan | |
| 6,979,107 | B1 | 12/2005 | Benensohn | |
| D522,677 | S | 6/2006 | Ming | |
| D522,678 | S | 6/2006 | Wang | |
| D523,984 | S | 6/2006 | Cai | |
| 7,066,619 | B2 | 6/2006 | Waters | |
| D526,433 | S | 8/2006 | Li | |
| D527,131 | S | 8/2006 | McCarthy, III | |
| D542,455 | S | 5/2007 | Newcomb | |
| D542,457 | S | 5/2007 | Fisherman et al. | |
| D543,304 | S | 5/2007 | Chan | |
| 7,270,443 | B2 | 9/2007 | Kurtz et al. | |
| D561,925 | S | 2/2008 | Levine | |
| D563,013 | S | 2/2008 | Levine | |
| D563,014 | S | 2/2008 | Levine | |
| D563,582 | S | 3/2008 | Levine | |
| D564,118 | S | 3/2008 | Wu | |
| D567,423 | S | 4/2008 | Shen | |
| 7,377,668 | B2 * | 5/2008 | Shemitz et al. | 362/225 |
| D576,334 | S | 9/2008 | Levine | |
| D576,338 | S | 9/2008 | Levine | |
| D578,246 | S | 10/2008 | Levine | |
| D578,703 | S | 10/2008 | Levine | |
| D581,077 | S | 11/2008 | Levine | |
| D581,569 | S | 11/2008 | Levine | |
| D581,570 | S | 11/2008 | Levine | |
| D581,571 | S | 11/2008 | Levine | |
| D581,572 | S | 11/2008 | Levine | |
| D582,601 | S | 12/2008 | Levine | |
| D585,152 | S | 1/2009 | Levine | |
| D585,578 | S | 1/2009 | Levine | |
| D586,491 | S | 2/2009 | Levine | |
| 2001/0009511 | A1 | 7/2001 | Griffiths | |
| 2002/0145876 | A1 | 10/2002 | Juang | |
| 2003/0179572 | A1 | 9/2003 | Schnell | |
| 2004/0240090 | A1 | 12/2004 | Skiver et al. | |
| 2005/0007778 | A1 | 1/2005 | Lin | |
| 2005/0018426 | A1 * | 1/2005 | Dickie | 362/287 |
| 2006/0050519 | A1 | 3/2006 | Lin | |
| 2006/0092637 | A1 | 5/2006 | Yeh | |
| 2006/0250789 | A1 | 11/2006 | Coushaine | |
| 2006/0256584 | A1 | 11/2006 | Paoluccio | |
| 2007/0070645 | A1 | 3/2007 | Coushaine et al. | |
| 2007/0097689 | A1 | 5/2007 | Barausky et al. | |
| 2008/0137326 | A1 | 6/2008 | Levine | |

OTHER PUBLICATIONS

"Fulcrum 113311-301 Flyweight Travel Booklight," http://www.amazon.com/Fulcrum-113311-301-Flyweight-Travel-Booklight/dp/B0006JN7XC, visited Aug. 17, 2007, 1 page.

"Koncept Z-Bar LED Lamp," http://www,konceptech.com/Merchant2/merchantmv?Screen=PROD&Store_Code=K&Product_Code=LL3001-MBK, visited Jan. 27, 2007, 1 page.

* cited by examiner

COMPACT LIGHTING DEVICE

FIELD

This disclosure concerns lighting devices, such as compact lighting devices having a maneuverable light source housing connected to a base.

BACKGROUND

Several varieties of compact lighting devices are known. For example, U.S. Pat. No. 5,871,274 (US'274) discloses a "stretchable and contractable [sic] desk lamp" with a "lamp shade . . . pivotally connected [to a] stand." US'274, abstract. The lighting device disclosed in US'274 must be placed upright and only is capable of directing light toward an area immediately surrounding its stand. US'274, FIG. 3. Another example of a compact lighting device is disclosed in U.S. Pat. No. 5,169,226 (US'226). The lighting device disclosed in US'226 includes "a flat thin battery case with laterally spaced battery chambers defining an upwardly opening channel therebetween." US'226, abstract. The upwardly opening channel "receives an elongate support arm" with a pivot point at one end and a lamp housing at the opposite end. US'226, abstract and FIG. 1. Like the lighting device disclosed in US'274, the lighting device disclosed in US'226 must be placed upright. In addition, the lighting device disclosed in US'226 only is capable of directing light toward an area aligned with its elongate support arm. The lighting devices disclosed in US'274 and US'226 are compact, but they only function as desk lights with limited range.

SUMMARY

Disclosed herein are embodiments of a lighting device. Some embodiments include a base, a light source housing, and a connection member connected between the base and the light source housing. The light source housing can be elongated and can include one or more battery-powered lighting elements, such as light-emitting diodes. These lighting elements can be positioned, for example, along a long axis of the light source housing, such as behind a substantially transparent window of a light assembly. The length of the substantially transparent window can be, for example, between about 50% and about 100% of the length of the light source housing. In some embodiments, the light assembly is rotatable relative to a remainder of the light source housing. The light source housing also can include a lighting element on an end of the light source housing opposite to an end connected to the connection member. This lighting element can be positioned, for example, behind a substantially transparent window having a surface substantially perpendicular to a long axis of the light source housing.

The light source housing and the connection member together can be rotatable relative to the base around a first axis, such as a first axis that is substantially parallel to a long axis of an elongated base. In such embodiments, the light source housing also can be rotatable relative to the connection member around a second axis substantially parallel to the first axis and a third axis substantially perpendicular to the first axis. Embodiments of the disclosed lighting device also can include a first connection member and a second connection member. The second connection member can be connected between the first connection member and the light source housing. In these embodiments, the light source housing and the second connection member together can be rotatable relative to the first connection member around the second axis. In addition, the light source housing can be rotatable relative to the first and second connection members around the third axis.

Some embodiments of the disclosed lighting device include a mounting plate configured to allow the lighting device to be mounted to a mounting surface. For example, in embodiments in which the base is elongated, the mounting plate can be positioned within or adjacent to a major surface of a bottom wall of the base. The mounting plate can be rotatable relative to a remainder of the lighting device. For example, the mounting plate can be positioned such that, when the mounting plate is fixedly attached to the mounting surface, the remainder of the lighting device is free to rotate relative to the mounting plate in a plane substantially parallel to the mounting surface. The mounting plate also can be detachable from the remainder of the lighting device without the use of tools.

Batteries to power the lighting elements can be positioned within a battery compartment in the base. This battery compartment can be within a battery pack that is removable from the base without the use of tools. For example, in embodiments in which the base is elongated, the battery pack can be removable from the base by sliding in a direction substantially parallel to a long axis of the base.

Some embodiments of the disclosed lighting device are convertible between a compact configuration and an expanded configuration. For example, in embodiments in which the base and the light source housing are elongated, a long axis of the elongated base can be substantially parallel to a long axis of the elongated light source housing in the compact configuration. In the expanded configuration, the elongated light source housing can be rotated greater than about 90° relative to its position in the compact configuration around a rotation axis substantially perpendicular to the long axis of the elongated base.

Certain relative dimensions of the disclosed lighting device can contribute to its compactness. For example, in embodiments in which the base and the light source housing are elongated, the length of the elongated base can be substantially the same as the length of the elongated light source housing. Furthermore, the average distance between the elongated base and the elongated light source housing in the compact configuration can be less than about five centimeters. Some embodiments have a first rotation axis substantially parallel to the long axis of the elongated base, a second rotation axis substantially parallel to the long axis of the elongated base, and a third rotation axis substantially perpendicular to the long axis of the elongated base. In these embodiments, the average distance between the first rotation axis and the second rotation axis can be less than about twice the sum of a maximum width of the elongated base plus a maximum width of the elongated light source housing.

DETAILED DESCRIPTION

Figure 1:
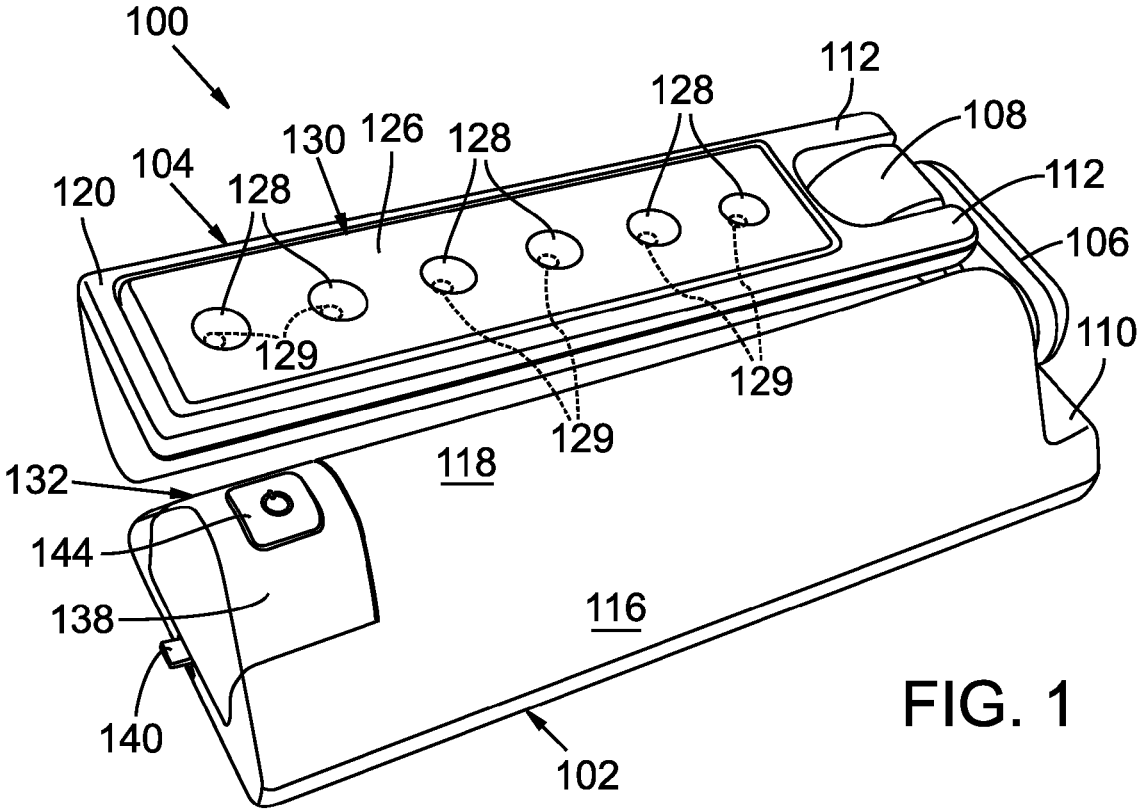
FIG. 1 is a perspective view of one embodiment of the disclosed lighting device in a compact configuration with its elongated light source housing adjacent to its elongated base.

Throughout this disclosure, the singular terms "a," "an," and "the" include plural referents unless the context clearly indicates otherwise. Similarly, the word "or" is intended to include "and" unless the context clearly indicates otherwise. As used herein the word "connected" does not exclude the presence of one or more intervening elements. The word "rotatable" means capable of pivoting at least 5° around an axis unless the context clearly indicates otherwise. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Described herein are embodiments of a lighting device. Some disclosed embodiments can function as desk lights when placed upright on a flat surface or as under-cabinet lights when mounted upside down below a flat surface. Most of these embodiments also can be mounted to vertical surfaces or to angled surfaces. These embodiments typically include a base and a light source housing. The light source housing can be connected to the base so as to allow rotation in two or more separate planes. Thus, the light source housing typically is maneuverable enough to direct light toward a specific area to be illuminated. In some disclosed embodiments, the base is can be rotationally mounted to a mounting surface, allowing for even greater maneuverability. Furthermore, the lighting device, when mounted, can be readily detectable from the mounting surface so as to allow convenient use of the lighting device in areas other than the area in which it is mounted.

FIGS. 1-4 illustrate one embodiment of the disclosed lighting device. The illustrated lighting device 100 includes a base 102 and a light source housing 104. A first connection member 106 and a second connection member 108 are connected between the base 102 and the light source housing 104. Two rotational connection points are spaced apart along one side of the first connection member 106. At the first rotational connection point (not shown), the first connection member 106 is rotatably connected to the base 102. At the second rotational connection point (not shown), the first connection member 106 is rotatably connected to the second connection member 108. In the illustrated embodiment, the first connection member 106 is substantially straight and the interface between the first connection member 106 and the base 102 is substantially coplanar with the interface between the first connection member 106 and the second connection member 108. In other embodiments, the first connection member 106 can include one or more curves or bends.

Since both the base 102 and the light source housing 104 are rotatably connected to the first connection member 106, the light source housing can be rotated relative to the base without changing its orientation. For example, FIG. 1 shows the light source housing 104 facing upward and positioned along one side of the base 102. From its position in FIG. 1, the light source housing 104 can be rotated so that it still faces upward, but is positioned directly above or along the opposite side of the base 102. The light source housing 104 also can be rotated at the second rotational connection point without rotating at the first rotational connection point. For example, from its position in FIG. 1, the light source housing 104 and the second connection member 108 can be rotated so that the light source housing faces to the side or downward. At the first rotational connection point, the first connection member 106 can rotate through a range of about 180° relative to the base 102. Further rotation is blocked by a platform 110 extending from the base 102. At the second rotational connection point, the light source housing 104 and the second connection member 108 also can rotate through a range of about 180° relative to the base 102. In other embodiments, the rotational ranges at the first and second rotational connection points can be different. For example, in some embodiments, the light source housing 104 and the second connection member 108 can rotate a full 360° relative to the base 102 at the second rotational connection point.

In the illustrated lighting device 100, the second connection member 108 is positioned between two projections 112 at one end of the light source housing 104. The inside walls of the two projections 112 are rotatably connected to opposite side walls of the second connection member 108. The light source housing 104 can rotate relative to the second connection member 108 around an axis substantially perpendicular to the axis around which the second connection member can rotate relative to the first connection member 106. After a certain amount of rotation relative to the second connection member 108, further rotation of the light source housing 104 is blocked. The range through which the light source housing 104 can rotate relative to the second connection member 108 varies in different embodiments. In the illustrated lighting device 100, the light source housing 104 can rotate through a range of about 126° relative to the second connection member 108. In other embodiments, the light source housing 104 can rotate, for example, through a range of between about 40° and about 320°, such as between about 70° and about 180° or between about 90° and about 160°.

The rotatable joints in embodiments of the disclosed lighting device typically stay in position after partial rotation. For example, in the illustrated lighting device 100, the first connection member 106 can rotate at the first rotational connection point to any degree within its rotational range and will remain in the position to which it is rotated. This occurs because there is substantial friction within the joint. The joint at the second rotational connection point and the joint between the light source housing 104 and the second connection member 108 are not freely rotatable, but rather are rotatable between defined positions. Within these joints, there are nubs that slide between notches during rotation of the connected elements. An end user experiences a clicking sensation as this occurs. Each of the notches corresponds to one position. For example, the joint at the second rotational connection point includes seven notches, so the second connection member 108 is rotatable between seven different positions relative to the first connection member 106.

In FIG. 1, the lighting device 100 is shown in a compact configuration. This configuration facilitates shipping, packaging, and storage. In addition, when the base 102 is mounted to the underside of a horizontal surface, the lighting device 100 can function as an effective under-cabinet light while in the compact configuration. In an under-cabinet installation, the light source housing 104 also can be stowed in the compact configuration when not in use and extended so as to direct light toward an area to be illuminated as needed.

The relative dimensions of the elements of the lighting device 100 enhance its compactness. For example, the base 102 and the light source housing 104 both are elongated. The length of the base 102 (without the platform 110) is substantially equal to the length of the light source housing 104. The length that the platform 110 adds to the base 102 is substantially equal to the thickness of the first connection member 106. In addition, the distance between the first and second rotational connection points on the first connection member 106 is substantially equal to half the average width of the light source housing 104 plus half the average width of the base 102. Thus, when the light source housing 104 is folded back with its long axis substantially parallel to the long axis of the base 102, the light source housing and the base are positioned adjacent to each other in close proximity. For example, the average distance between the base 102 and the light source housing 104 can be less than about ten centimeters, such as less than about five centimeters or less than about two centimeters. In some embodiments, the distance between the axis of the first rotational connection point of the first connection member 106 and the axis of the second rotational connection point of the first connection member 106 is less than twice the sum of the maximum width of the base 102 plus the maximum width of the light source housing 104. Embodiments of the disclosed lighting device can include one, some, all, or none of the relative dimensions of the elements of the lighting device 100.

In the illustrated lighting device 100, the base 102 and the light source housing 104 each have substantially triangular cross sections in planes perpendicular to their lengths. The base 102 includes a bottom wall 114 (shown in FIG. 2) and two symmetrical side walls 116 (one shown in FIG. 1) that meet at a rounded corner 118 (shown in FIG. 1). Similarly, the light source housing 104 includes a face 120 (shown in FIG. 1) and two symmetrical side walls 122 (one shown in FIG. 2) that meet at a rounded corner 124 (shown in FIG. 2). In the compact configuration shown in FIGS. 1 and 2, the rounded corner 118 of the base 102 is pointing upward and the rounded corner 124 of the light source housing 104 is pointing downward. This allows the width of the overall lighting device 100 in the compact configuration to be less than the width of the bottom wall 114 of the base 102 plus the width of the face 120 of the light source housing 104. The complimentary cross sectional shapes of the base 102 and the light source housing 104 generally improve the compactness of the lighting device 100.

In other embodiments, the cross sections of the base 102 and the light source housing 104 can be the same or different. In addition, instead of substantially triangular cross sections of the base 102 and the light source housing 104, other embodiments can have bases and/or light source housings with different cross sectional shapes. For example, in some disclosed embodiments, the cross section of the base 102 and/or the cross section of the light source housing 104 substantially resemble a polygon (e.g., a parallelogram, a pentagon, a hexagon, a heptagon, or an octagon), a circle, an oval, or a circular segment (e.g., a semicircle).

The light source housing 104 includes a window 126 that can be made of plastic, glass, or another substantially optically transmissive material. The length of the window 126 can be, for example, between about 20% and about 100% of the length of the light source housing 104, such as between about 50% and about 100% or between about 60% and about 90%. The majority of the inside surface of the window 126 can be coated to give it a slightly frosted appearance. In the illustrated lighting device 100, the window 126 includes six uncoated regions 128, one above each of six individual lighting elements 129. To promote the transmission of light, the lighting elements 129 are mounted on a reflective backing (not shown) below the window 126. The illustrated lighting device 100 includes six lighting elements 129, but other embodiments can include a different number of lighting elements, such as one, two, three, four, five, seven, eight, nine, ten, or a greater number of lighting elements. The lighting elements 129 are arranged in a single row that is substantially parallel to the long axis of the light source housing 104. In other embodiments the lighting elements can have a different arrangement. For example, the lighting elements can be arranged in multiple rows that are substantially parallel to the long axis of the light source housing 104 or in one or more rows that are substantially perpendicular to the long axis of the light source housing. The lighting elements also can be arranged, for example, in clusters or in a staggered pattern.

In the illustrated embodiment, the lighting elements 129 are white light-emitting diodes. In other embodiments the lighting elements can be incandescent, fluorescent, halogen, xenon, neon, or some other commercially available lighting type. Light-emitting diodes are particularly well suited for use in disclosed embodiments due to their compact size, low power demand, low heat output, long life, and high durability. Instead of white light-emitting diodes, other embodiments can include light-emitting diodes of another color, such as red, orange, yellow, green, or blue.

Figure 4:
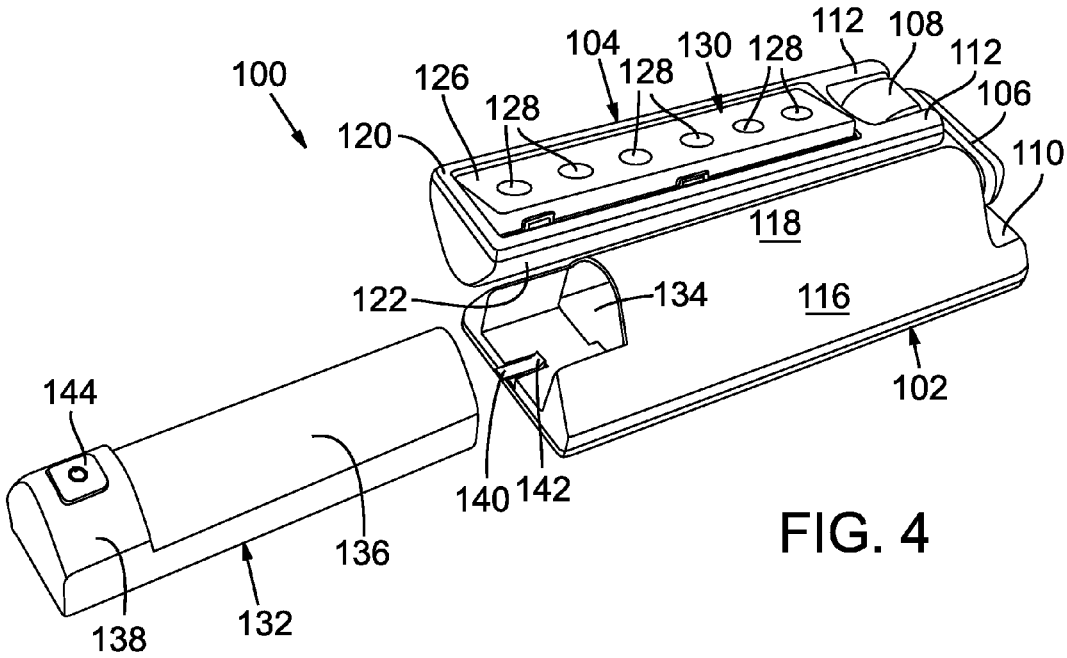
FIG. 4 is a perspective view of the embodiment shown in FIG. 1 in the compact configuration with its battery pack separated from its base and its light assembly tilted to one side.
Figure 5:
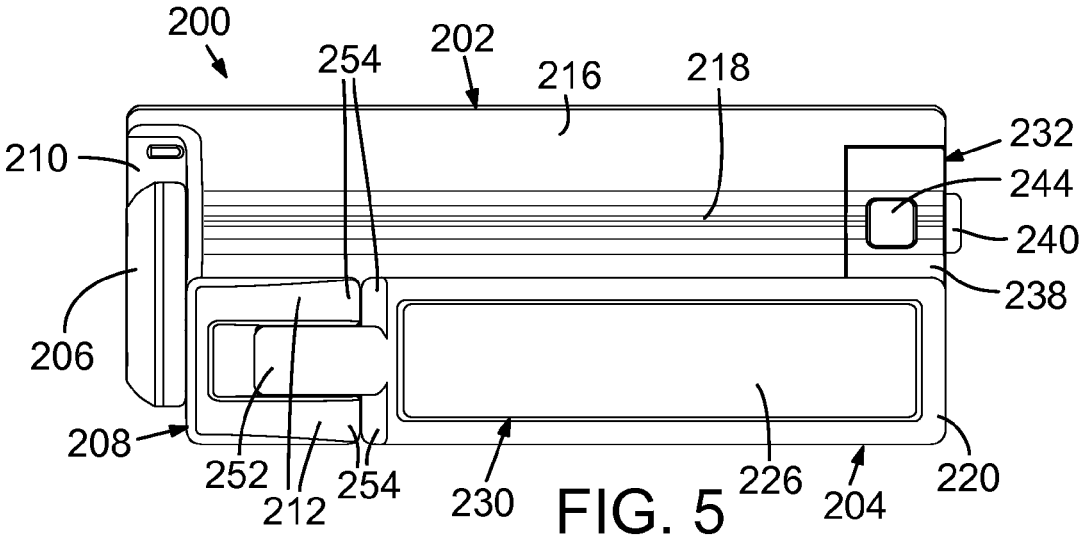
FIG. 5 is a top plan view of another embodiment of the disclosed lighting device in a compact configuration with its elongated light source housing adjacent to its elongated base.
Figure 6:
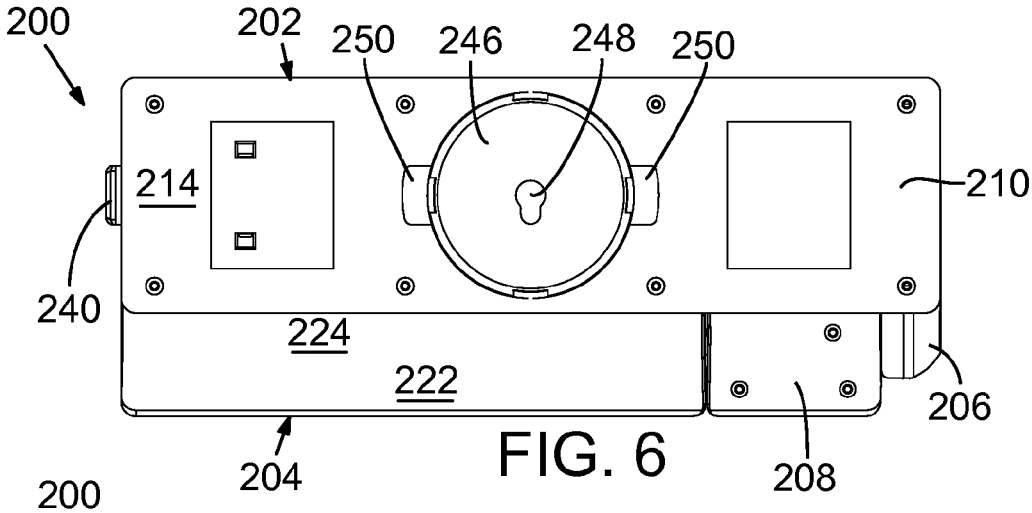
FIG. 6 is a bottom plan view of the embodiment shown in FIG. 5 in the compact configuration.
Figure 7:
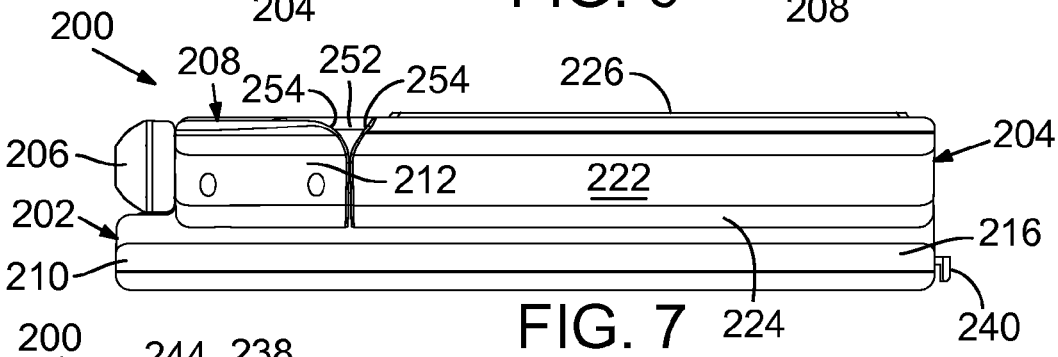
FIG. 7 is a first side profile view of the embodiment shown in FIG. 5 in the compact configuration.
Figure 8:
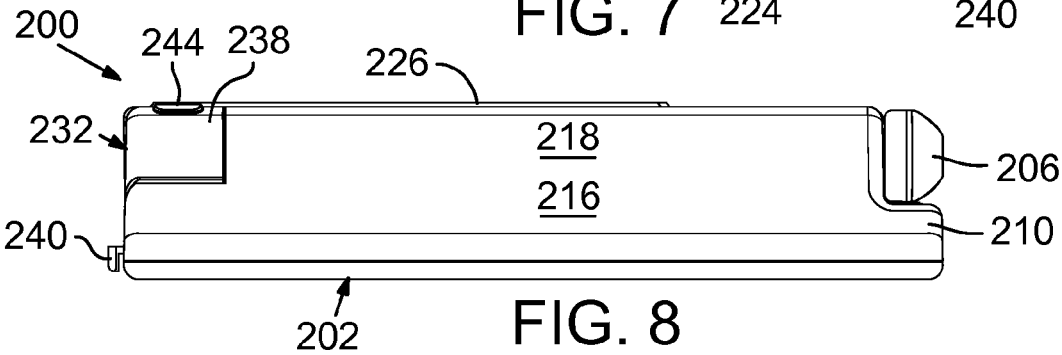
FIG. 8 is a second side profile view of the embodiment shown in FIG. 5 in the compact configuration.

Together, the window 126, the lighting elements 129, and the reflective backing form a light assembly 130. In the illustrated lighting device 100, the light assembly 130 can be tilted relative to other portions of the light source housing 104. FIG. 4 shows the lighting device 100 with the light assembly 130 tilted to one side around an axis substantially parallel to the long axis of the light source housing 104. The light assembly 130 also can be tilted to the opposite side.

The illustrated lighting device 100 is configured to hold batteries (not shown) within the base 102 to power the lighting elements 129. The weight of the batteries can help to prevent the lighting device 100 from tipping oven when the light source housing 104 is extended away from the base 102, such as in the expanded configuration shown in FIG. 3. Other embodiments, however, can be configured to hold batteries in another location, such as in the light source housing 104. Including the batteries in the light source housing 104 can minimize the need for electrical connections between different elements of the lighting device 100. This advantage may outweigh the stability advantage of including batteries in the base 102, particularly if the base is to be mounted to a mounting surface.

After prolonged use of the lighting device 100, it may become necessary to change the batteries. In some embodiments, there is a door in the bottom wall 114 of the base 102 through which the batteries can be removed and replaced. In many installations, however, it can be difficult to access the bottom wall 114 of the base 102, particularly if the base is mounted to a mounting surface. As an alternative, the illustrated lighting device 100 includes a battery pack 132 that is removable from the base 102 without the use of tools. As shown in FIG. 4, the battery pack 132 slides into a battery pack opening 134 at the end of the base 102 opposite to the end attached to the first connection member 106. The battery pack 132 is elongated and fits into the base 102 with its long axis substantially parallel to the long axis of the base. Along its length, the battery pack 132 includes a recessed portion 136 and a non-recessed portion 138. When installed in the base 102, the recessed portion 136 of the battery pack 132 is completely covered and the non-recessed portion 138 is exposed. Some external surfaces of the non-recessed portion 138 are substantially flush with external surfaces of the side walls 116 and the rounded corner 118 of the base 102.

The battery pack 132 is configured to hold three size AAA batteries stacked in a pyramid with the long axis of each battery substantially parallel to the long axis of the battery pack. These batteries are electrically connected in series with soldered connections (not shown) at the beginning and end of the series. Wires (not shown) extend from the soldered connections to contacts (not shown) on the end of the battery pack 132 opposite to the end that is visible when the battery pack is inserted into the base 102. When the battery pack 134 is inserted into the base 102, the contacts press against springs (not shown) in the base to establish an electrical connection. The springs are attached to wires (not shown) that extend through the first connection member 106, extend through the second connection member 108, and connect to a circuit board (not shown) within the light source housing 104. The circuit board is connected to the lighting elements 129. Other embodiments can include different power supply configurations. Embodiments powered by batteries can include any number, type, and arrangement of batteries, such as two AA batteries in series or one nine-volt battery directly connected to the circuit. Other embodiments can be hard wired to a permanent power source, such as a wall circuit.

To hold the battery pack 132 within the base 102, the bottom wall 114 of the base includes a clip 140. The clip 140 includes a raised portion 142 that fits into a notch (not shown) in the bottom wall (not shown) of the battery pack 132. Pressing down on a portion of the clip 140 extending from the base 102 causes the raised portion 142 of the clip 140 to move downward, freeing the battery pack 132 from the base 102. When released, the springs that form the electrical connection between the battery pack 132 and the remainder of the lighting device 100 automatically press the battery pack out of the base 102. As the battery pack 132 is reinserted into the base 102, the bottom wall of the battery pack presses the raised portion 142 of the clip 140 downward until the battery pack is fully inserted. After the battery pack 132 is fully inserted, the raised portion 142 of the clip 140 springs upward into the notch in the bottom wall of the battery pack to again hold the battery pack in position.

A power button 144 is located on the non-recessed portion 138 of the battery pack 132. When the battery pack 132 is installed, the power button 144 is positioned along the rounded corner 118 of the base 102. When the power button 144 is depressed, the lighting elements 129 turn on or off. The power button 144 also can be configured to toggle the lighting elements 129 between different levels of light intensity. For example, a single press of the power button 144 can turn on the lighting elements 129, a second press of the power button can increase the light intensity, and a third press of the power button can turn off the lighting elements. Alternatively, the power button 144 can be configured to toggle between the activation of different numbers of lighting elements 129 from among a plurality of lighting elements. For example, a single press of the power button 144 can turn on a limited number of lighting elements 129, a second press of the power button can increase the number of illuminated lighting elements, and a third press of the power button can turn off all the lighting elements. The functionality of toggling the light intensity or the number of illuminated lighting elements 129 can be incorporated by including a commercially available dimmer or toggle switch on the circuit board. Instead of a power button 144, other embodiments can include another type of switch, such as a toggle switch or a rocker switch. Such switches can be positioned, for example, on a portion of the lighting device 100 other than the battery pack 132.

Figure 2:
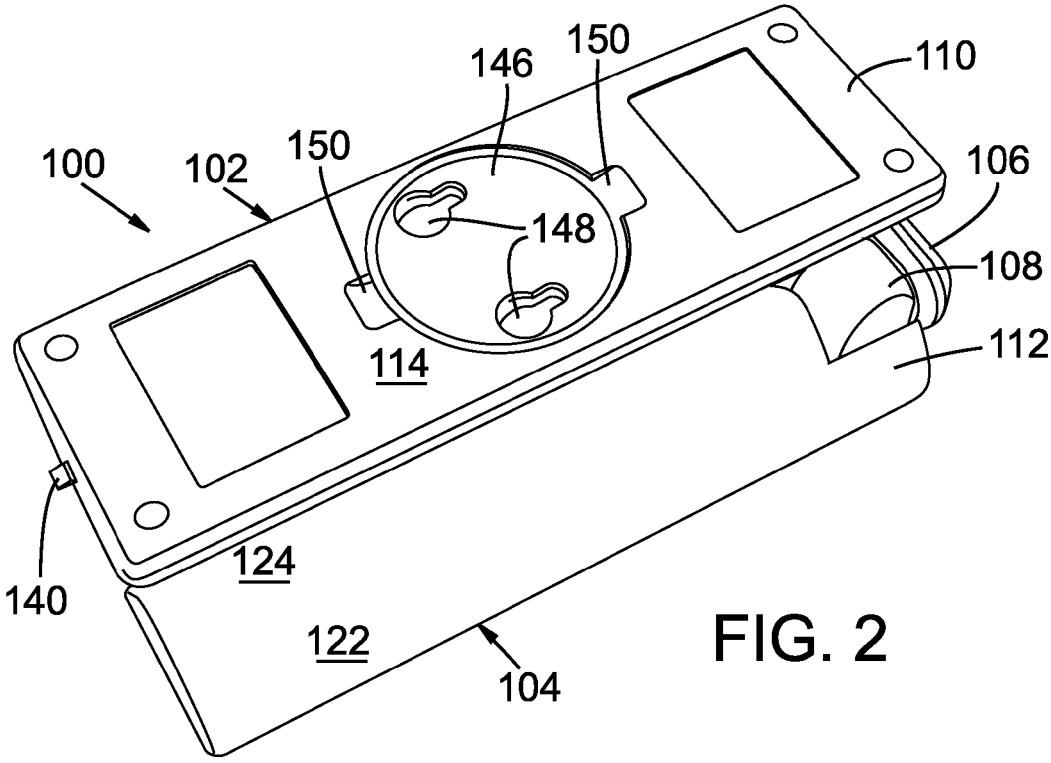
FIG. 2 is a perspective view of the underside of the embodiment shown in FIG. 1 in the compact configuration.
Figure 3:
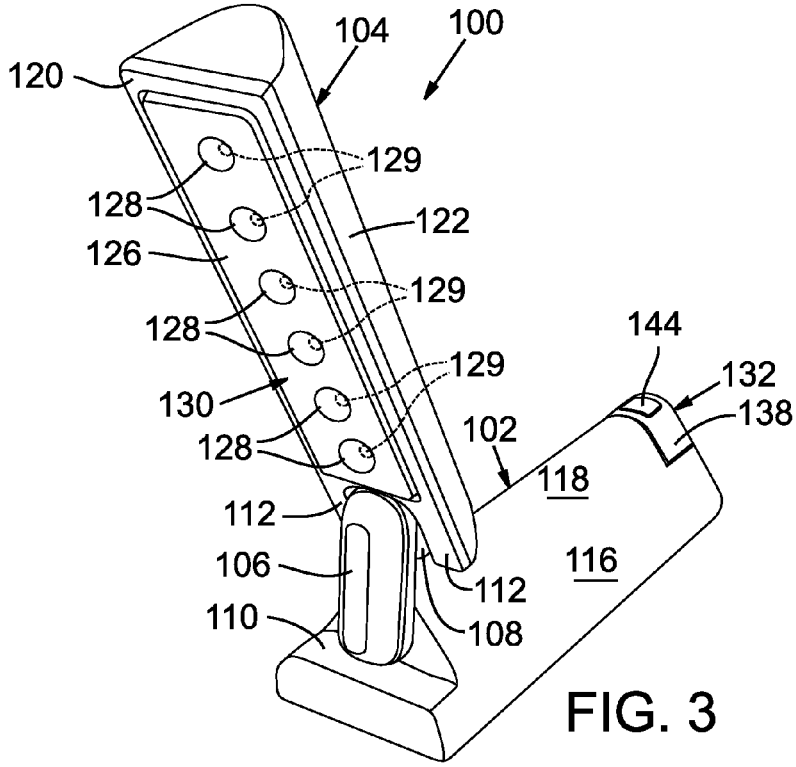
FIG. 3 is a perspective view of the embodiment shown in FIG. 1 in an expanded configuration with its elongated light source housing extended away from its elongated base.

As shown in FIG. 2, the bottom wall 114 of the base 102 includes a mounting plate 146. The mounting plate 146 can be attached to a mounting surface, such as a wall, the top of a desk, or the bottom of a cabinet. In the illustrated lighting device 100, the mounting plate 146 includes two mounting holes 148. The mounting holes 148 can receive the heads of screws or other fasteners attached to the mounting surface. Other embodiments can include a different number of mounting holes 148 (e.g., one, three, or four) or a completely different mounting mechanism. Alternative mounting mechanisms can include, for example, magnetic material, hook and loop material, or tape attached to the mounting plate 146 or to another portion of the bottom wall 114 of the base 102. The mounting material (e.g., magnetic material, hook and loop material, or tape) can be placed within a recessed portion of the mounting plate 146 or within a recessed portion of another portion of the bottom wall 114 of the base 102. This can allow the lighting device 100 to be mounted substantially flush with the mounting surface.

In the illustrated lighting device 100, the mounting plate 146 is round and rotatable. Specifically, the mounting plate 146 includes four flanged tabs that fit around a rim of the bottom wall 114 of the base 102. When attached to a mounting surface, all portions of the lighting device 100 other than the mounting plate 146 can rotate in a plane substantially parallel to the mounting surface. This increases the range over which the light source housing 104 can be aimed.

In addition to being rotatable relative to the remainder of the lighting device 100, the mounting plate 146 is removable without the use of tools. As shown in FIG. 2, the bottom wall 114 of the base 102 includes two notches 150 around the outside of the mounting plate 146. Applying leverage to the mounting plate 146 via one or both of these notches 150 causes the mounting plate to snap out of a recess (not shown) within the bottom wall 114 of the base 102. Similarly, when the mounting plate 146 is attached to a mounting surface, firmly pulling the lighting device 100 away from the mounting surface can cause separation of the mounting plate. In some alternative embodiments, the mounting plate 146 is removable from a mounting surface, for example, by separation of magnets or by separation of corresponding pieces of hook and loop material.

Embodiments of the disclosed lighting device that can be removably mounted, such as the illustrated lighting device 100, can be conveniently switched between different applications. For example, an end user may have the lighting device 100 installed under a cabinet. To illuminate items in the vicinity of the mounted lighting device 100, the end user can manipulate the light source housing 104 and/or rotate the lighting device around the mounting plate 146. If the end user wishes to use the lighting device 100 in a different area, the end user can pull down on the lighting device so that it separated from the mounting plate 146. When the end user has finished using the lighting device 100, the end user can return it to its original position by aligning the recess in the bottom wall 114 of the base 102 with the mounting plate 146 and pushing upwards until the mounting plate snaps into the recess.

The lighting device 100 has many uses in an unmounted state. For example, in the expanded configuration shown in FIG. 3, the lighting device 100 need not be mounted to serve as a desk light. The lighting device 100 can be readily converted between the compact configuration shown in FIG. 1 and the expanded configuration shown in FIG. 3. For example, from the compact configuration shown in FIG. 1, the light source housing 104, the second connection member 108, and the first connection member 106 can be rotated at the first rotational connection point relative to the base 102 until the long axis of the first connection member is substantially vertical. The light source housing 104 and the second connection member 108 then can be rotated relative to the first connection member 106 until the face 120 of the light source housing is substantially parallel to the bottom wall 114 of the base 102. From this point, the light source housing 104 can be rotated relative to the second connection member 108 so that it extends over an area not occupied by the base 102. The light source housing 104 can be further adjusted as necessary to direct light to a specific area to be illuminated.

FIGS. 5-11 illustrate a second embodiment of the disclosed lighting device. The first digit of each reference number shown in FIGS. 5-11 is "2." The second two digits of the reference numbers shown in FIGS. 5-11 are identical to the second two digits of the reference numbers shown in FIGS. 1-4 for similar or identical elements.

The primary difference between the lighting device 200 shown in FIGS. 5-11 and the lighting device 100 shown in FIGS. 1-4 is the shape of the second connection member 208 and the shape of the portion of the light source housing 204 that connects to the second connection member. In the lighting device 200, the two projections 212 are part of the second connection member 208 rather than the light source housing 204. Thus, the second connection member 208 has a "U" shape. The light source housing 204 includes a centered projection 252 that fits between the two projections 212 of the second connection member 208. The inside walls of the two projections 212 are rotatably connected to opposite side walls of the centered projection 252. As shown, for example, in FIG. 7, the two projections 212 of the second connection member 208 and two portions of the light source housing 204 on either side of the centered projection 252 have rounded corners 254. The rounded corners 254 provide clearance for the light source housing 204 to rotate relative to the second connection member 208.

Figure 9:
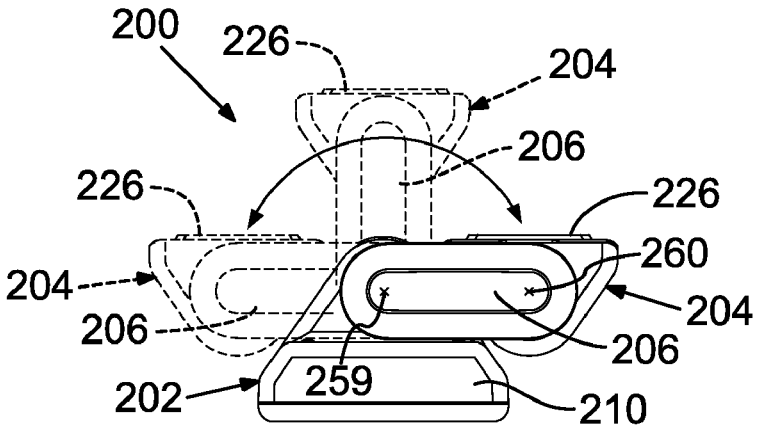
FIG. 9 is a first end profile view of the embodiment shown in FIG. 5 in the compact configuration.
Figure 10:
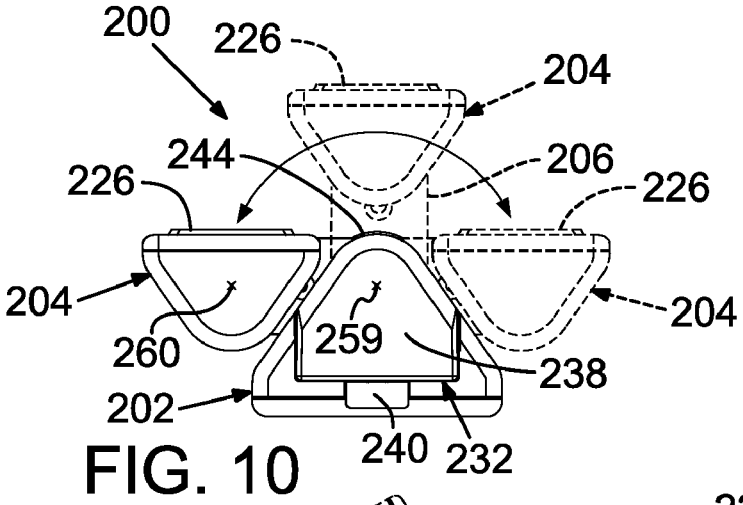
FIG. 10 is a second end profile view of the embodiment shown in FIG. 5 in the compact configuration.
Figure 11:
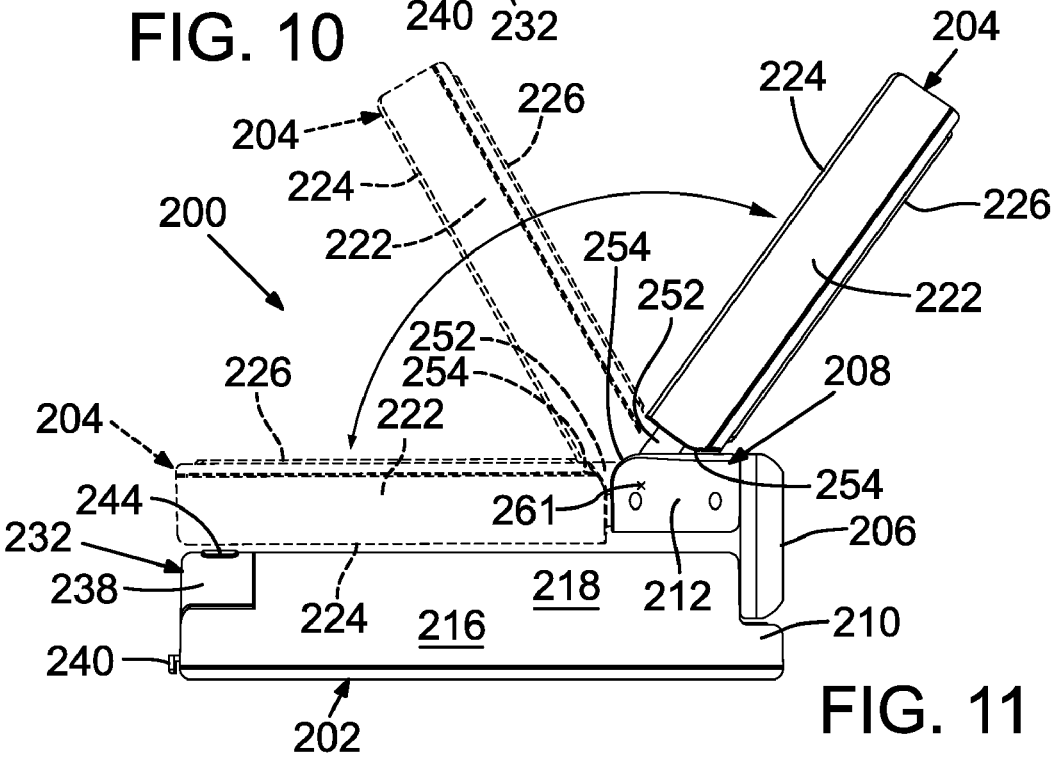
FIG. 11 is a side profile view of the embodiment shown in FIG. 5 in an expanded configuration with its elongated light source housing extended away from its elongated base.

FIGS. 9-11 include arrows indicating the range of motion of different elements of the lighting device 200. Specifically, the arrows in FIGS. 9 and 10 indicate the range of motion of the light source housing 204, the first connection member 206, and the second connection member 208 relative to the base 202 around a first axis 259. FIGS. 9 and 10 also show the rotation of the light source housing 204 and the second connection member 208 relative to the first connection member 206 and the base 202 around a second axis 260. The arrow in FIG. 11 indicates the range of motion of the light source housing 204 relative to the base 202, the first connection member 206, and the second connection member 208 around a third axis 261. These ranges are comparable to the ranges described with reference to the lighting device 100 shown in FIGS. 1-4.

Figure 12:
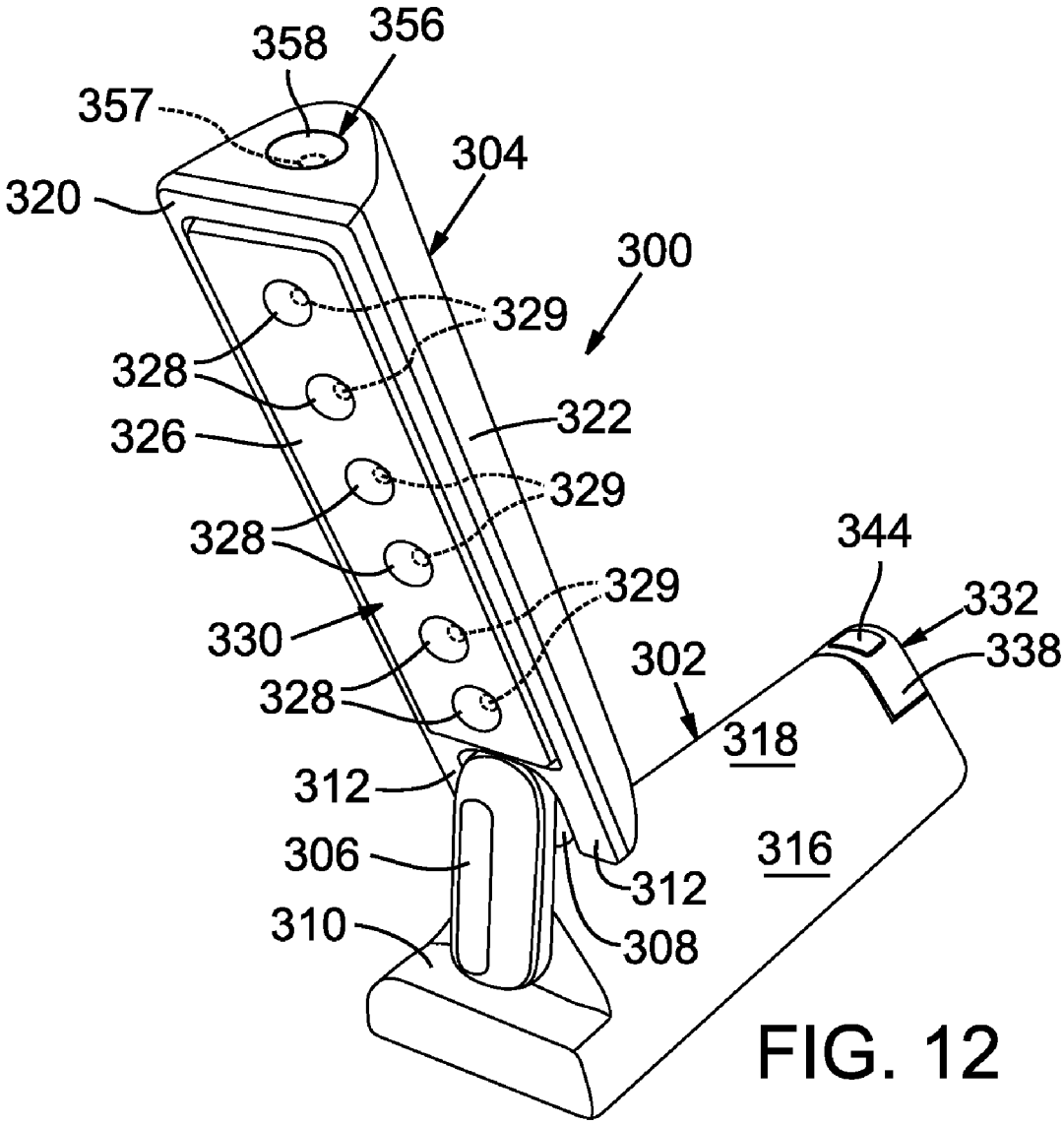
FIG. 12 is a perspective view of another embodiment of the disclosed lighting device in an expanded configuration with its elongated light source housing extended away from its elongated base.

FIG. 12 illustrates a third embodiment of the disclosed lighting device. The first digit of each reference number shown in FIG. 12 is "3." The second two digits of the reference numbers shown in FIG. 12 are identical to the second two digits of the reference numbers shown in FIGS. 1-11 for similar or identical elements. The lighting device 300 shown in FIG. 12 is the same as the lighting device 100 shown in FIGS. 1-4, except that it additionally includes an end light 356 on an end of the light source housing 304 opposite to an end connected to the second connection member 108. The end light 356 includes a lighting element 357 behind an end light window 358. As with the other lighting elements in the lighting device 300, the lighting element 357 in the end light 356 can be a light-emitting diode.

Embodiments of the disclosed lighting device can include a variety of features in addition to or in place of those described above and shown in FIGS. 1-12. For example, some embodiments include a sensor that activates and deactivates the lighting elements. In some embodiments, this sensor is a light sensor, such as a commercially available light sensor that activates the lighting elements when light from another source is detected. This can be useful for applications in which the disclosed lighting device is not the primary lighting device for an area. Once the primary lighting device for an area (e.g., an overhead light) is activated, embodiments of the disclosed lighting device can be configured to activate automatically. In this way, secondary lighting, such as accent lighting, can be activated without the need for manual intervention. By the same principle, the lighting device can be activated by a motion sensor, such as a commercially available motion sensor. Embodiments including a sensor also can include a manual override switch to deactivate the sensor when automatic operation is not desirable. The manual override switch can be, for example, a commercially available switch that switches the flow of electrical current between a circuit including the sensor and a circuit not including the sensor.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A lighting device, comprising:

a base;

a light source housing;

a first connection member; and a second connection member, wherein the light source housing includes one or more battery-powered lighting elements, the first connection member is connected between the base and the second connection member, the second connection member is connected between the first connection member and the light source housing, the light source housing, the first connection member, and the second connection member together are rotatable relative to the base around a first axis, the light source housing and the second connection member together are rotatable relative to the first connection member and the base around a second axis substantially parallel to the first axis, and the light source housing is rotatable relative to the first connection member, the second connection member, and the base around a third axis substantially perpendicular to the first axis.

2. The lighting device according to claim 1, wherein the base is elongated, and the first axis is substantially parallel to a long axis of the base.

3. The lighting device according to claim 1, wherein the battery-powered lighting elements are positioned behind a substantially transparent window of a light assembly, and the light assembly is rotatable relative to a remainder of the light source lighting.

4. The lighting device according to claim 1, wherein the base includes a battery compartment.

5. The lighting device according to claim 4, wherein the battery compartment is within a battery pack, and the battery pack is removable from the base without the use of tools.

6. The lighting device according to claim 5, wherein the base is elongated and the battery pack is removable from the base by sliding in a direction substantially parallel to a long axis of the base.

7. The lighting device according to claim 1, wherein the light source housing is elongated.

8. The lighting device according to claim 7, wherein the light source housing includes a battery-powered lighting element on an end of the light source housing opposite to an end connected to the second connection member.

9. The lighting device according to claim 8, wherein the battery-powered lighting element positioned on an end of the light source housing opposite to the end connected to the second connection member is behind a substantially transparent window having a surface substantially perpendicular to a long axis of the light source housing.

10. The lighting device according to claim 7, wherein the light source housing includes a plurality of light-emitting diodes positioned along a long axis of the light source housing.

11. The lighting device according to claim 10, wherein the light-emitting diodes are positioned behind a substantially transparent window, and the length of the substantially transparent window is between about 50% and about 100% of the length of the light source housing.

12. The lighting device according to claim 7, wherein the base is elongated and the length of the base is substantially the same as the length of the light source housing.

13. The lighting device according to claim 7, wherein the base is elongated and the average distance between the first axis and the second axis is less than about twice the sum of a maximum width of the base plus a maximum width of the light source housing.

14. The lighting device according to claim 1, further comprising a mounting plate rotatable relative to a remainder of the lighting device.

15. The lighting device according to claim 14, wherein the mounting plate is detachable from the remainder of the lighting device without the use of tools.

16. The lighting device according to claim 14, wherein the base is elongated and includes a bottom wall with a major surface, and the mounting plate is positioned within or adjacent to the major surface of the bottom wall of the base.

17. The lighting device according to claim 14, wherein the mounting plate is positioned such that, when the mounting plate is fixedly attached to a mounting surface, the remainder of the lighting device is free to rotate relative to the mounting plate in a plane substantially parallel to the mounting surface.

* * * * *

UNITED STATES PATENT AND TRADEMARK OFFICE

CERTIFICATE OF CORRECTION

PATENT NO. : 7,591,572 B1
APPLICATION NO. : 11/734022
DATED : September 22, 2009
INVENTOR(S) : Jonathan E. Levine It is certified that error appears in the above-identified patent and that said Letters Patent is hereby corrected as shown below:

Column 11, line 3, "lighting" should read --housing--.

Signed and Sealed this

Nineteenth Day of January, 2010

David J. Kappos

David J. Kappos
*Director of the United States Patent and Trademark Office*